US011171414B2

(12) United States Patent
Yeom et al.

(10) Patent No.: US 11,171,414 B2
(45) Date of Patent: Nov. 9, 2021

(54) ELECTRONIC DEVICE HAVING PLURALITY OF ANTENNAS

(71) Applicant: Samsung Electronics Co., Ltd., Gyeonggi-do (KR)

(72) Inventors: Junghwan Yeom, Gyeonggi-do (KR); Kukjeong Kim, Gyeonggi-do (KR); Wonwook Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/750,103

(22) Filed: Jan. 23, 2020

(65) Prior Publication Data

US 2020/0243964 A1 Jul. 30, 2020

(30) Foreign Application Priority Data

Jan. 25, 2019 (KR) ..... 10-2019-0010142

(51) Int. Cl.
*H01Q 1/38* (2006.01)
*H01Q 1/52* (2006.01)
*H01Q 9/04* (2006.01)

(52) U.S. Cl.
CPC ..... *H01Q 1/52* (2013.01); *H01Q 1/38* (2013.01); *H01Q 9/0421* (2013.01)

(58) Field of Classification Search
CPC ..... H01Q 1/38; H01Q 1/52; H01Q 9/0421
USPC ..... 455/575
See application file for complete search history.

(56) References Cited

U.S. PATENT DOCUMENTS

| | | | | |
|---|---|---|---|---|
| 8,922,448 | B2 | 12/2014 | Wong et al. | |
| 9,035,830 | B2 | 5/2015 | Komulainen et al. | |
| 9,722,300 | B2 | 8/2017 | Choi et al. | |
| 2013/0234911 | A1 | 9/2013 | Lee | |
| 2015/0061962 | A1 | 3/2015 | Lee et al. | |
| 2016/0226139 | A1* | 8/2016 | Yu | H01Q 9/42 |
| 2018/0019515 | A1* | 1/2018 | Zhang | H01Q 9/42 |
| 2018/0108984 | A1 | 4/2018 | Wu et al. | |
| 2018/0261921 | A1 | 9/2018 | Ha et al. | |
| 2018/0323497 | A1 | 11/2018 | Kang et al. | |

FOREIGN PATENT DOCUMENTS

| | | | |
|---|---|---|---|
| KR | 10-2015-0118481 | A | 10/2015 |
| KR | 10-2016-0069923 | A | 6/2016 |
| KR | 10-2018-0016921 | A | 2/2018 |

OTHER PUBLICATIONS

International Search Report dated May 18, 2020.

* cited by examiner

*Primary Examiner* — Ted M Wang
(74) *Attorney, Agent, or Firm* — Cha & Reiter, LLC

(57) ABSTRACT

An electronic device having a plurality of antennas is provided. The electronic device includes a housing, a printed circuit board positioned within the housing, and including a ground, a wireless communication circuit mounted on the printed circuit board, a first antenna configured to transmit or receive a first wireless signal with the wireless communication circuit, and a second antenna configured to transmit or receive a second wireless signal with the wireless communication circuit. The first antenna includes a first short-circuit pattern connected to the ground, and the second antenna includes a second short-circuit pattern connected to the ground. At least part of the first short-circuit pattern and at least part of the second short-circuit pattern are arranged to be adjacently occurred a decoupling resonance.

14 Claims, 8 Drawing Sheets

ELECTRONIC DEVICE HAVING PLURALITY OF ANTENNAS

CROSS-REFERENCE TO RELATED APPLICATION(S)

This application is based on and claims priority under 35 U.S.C. § 119 to Korean Patent Application No. 10-2019-0010142, filed on "Jan. 25, 2019", in the Korean Intellectual Property Office, the disclosure of which is incorporated by reference herein in its entirety.

BACKGROUND

Field

Certain embodiments of the present disclosure relate to an electronic device including a plurality of antennas.

Description of Related Art

Electronic devices (e.g., mobile terminals, smart phones, or wearable devices) can provide various functions. For example, the smart phone can provide, in addition to a basic voice communication function, various functions such as a short-range wireless communication (e.g., Bluetooth (BT), wireless fidelity (Wi-Fi), or near field communication (NFC)) function, a mobile communication (e.g., 3-generation (3G), 4G 5G etc.) function, a music or video play function, a photographing function, or a navigation function.

To provide wireless communication using a multiple communication formats, electronic devices can include at least one antenna. The recently electronic devices include a plurality of antennas. For example, the electronic devices include a multi input multi output (MIMO) antenna, or a diversity antenna.

The above information is presented as background information only to assist with an understanding of the present disclosure. No determination has been made, and no assertion is made, as to whether any of the above might be applicable as prior art with regard to the present disclosure.

SUMMARY

However, if the plurality of antennas are adjacent, a mutual interference phenomenon can occur. For example, an electromagnetic (EM) coupling phenomenon between the adjacent antennas can occur. The interference can deteriorate a communication quality of an electronic device. To prevent the EM coupling, the antennas should be arranged to be sufficiently spaced apart from one another. However, in a portable electronic device having a limited size, it can be difficult to space apart the antennas by more than a limited distance.

To take disadvantage of the foregoing, antenna(s) are needed that provide good communication quality. Certain embodiments of the present disclosure may provide an antenna structure capable of improving an EM isolation between antennas, and decrease EM coupling, and improve radiation efficiency.

Technological solutions the present document seeks to achieve are not limited to the above-mentioned technological solutions, and other technological solutions not mentioned above would be able to be clearly understood by a person having ordinary skill in the art from the following statement.

According to certain embodiments, an electronic device comprises a housing; a printed circuit board positioned within the housing, and comprising a ground; a wireless communication circuit mounted on the printed circuit board; a first antenna configured to transmit or receive a first wireless signal with the wireless communication circuit; and a second antenna transmit or receive a second wireless signal with the wireless communication circuit, wherein the first antenna comprises a first short-circuit pattern connected to the ground, and the second antenna comprises a second short-circuit pattern connected to the ground, and at least part of the first short-circuit pattern and at least part of the second short-circuit pattern are adjacently arranged to decouple using resonance decoupling.

According to certain embodiments, an electronic device comprises a housing; a printed circuit board positioned within the housing, and comprising a ground; a wireless communication circuit mounted on the printed circuit board; a first antenna connected with the wireless communication circuit, and comprising a first short-circuit pattern; a second antenna connected with the wireless communication circuit, and comprising a second short-circuit pattern; a first decoupling pattern connected with the first short-circuit pattern; and a second decoupling pattern connected with the second short-circuit pattern, and disposed a specified distance from the first decoupling pattern, wherein at least part of the first decoupling pattern and at least part of the second decoupling pattern are adjacently arranged to decouple using resonance decoupling.

According to certain embodiments, an antenna apparatus comprises a housing; a first antenna positioned in one surface of the housing, and configured to transmit or receive a first wireless signal; a second antenna positioned in one surface of the housing, and configured to transmit or receive a second wireless signal; a first decoupling pattern connected with a first short-circuit pattern of the first antenna; and a second decoupling pattern connected with a second short-circuit pattern of the second antenna, and arranged within a specific distance from the first decoupling pattern, wherein at least part of the first decoupling pattern and at least part of the second decoupling pattern are adjacently arranged to be occurred a decoupling resonance.

DETAILED DESCRIPTION

Figure 1:
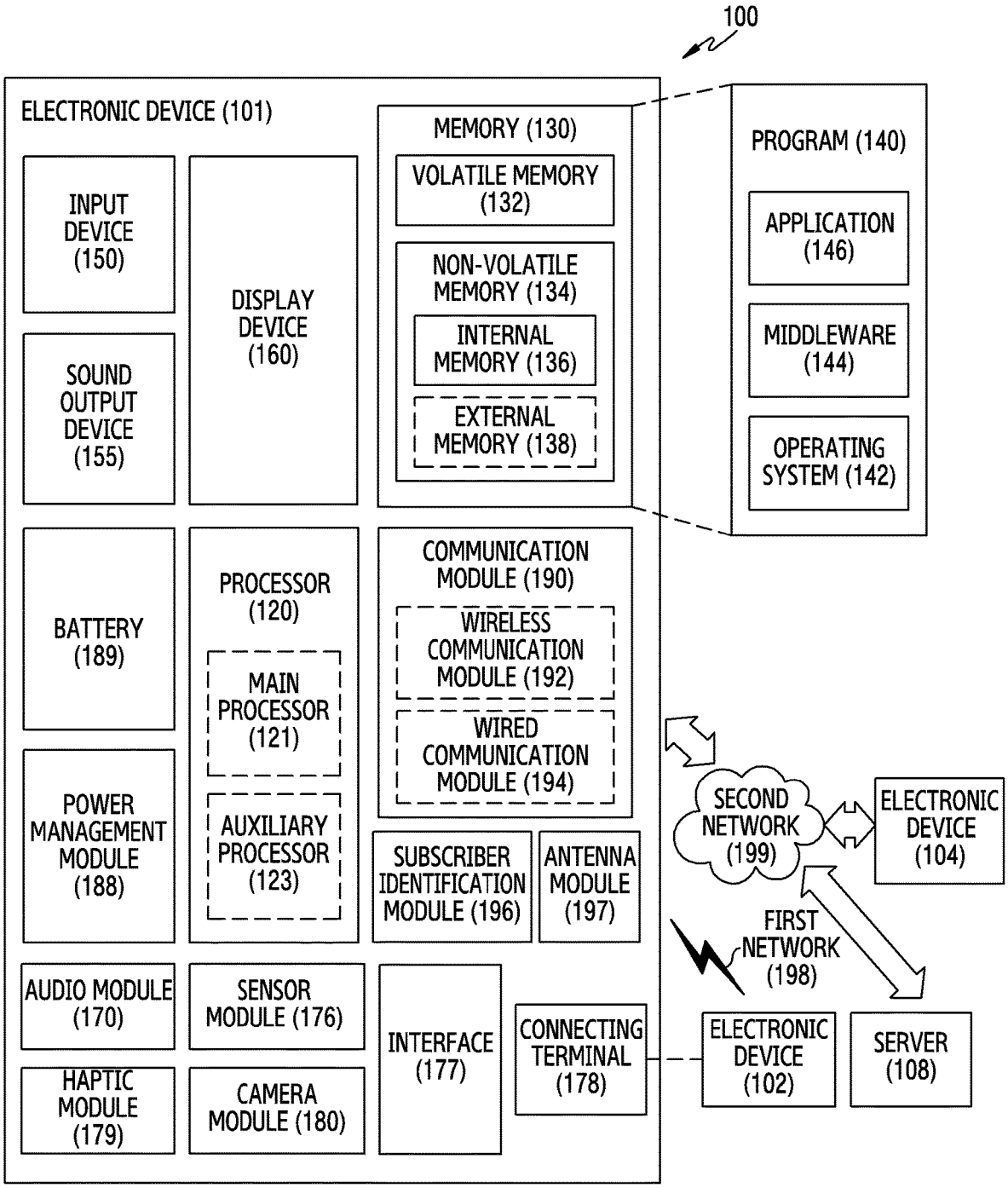
FIG. 1 is a block diagram of an electronic device within a network environment according to an embodiment of the present disclosure.

Certain embodiments of the present disclosure are described below with reference the accompanying drawings. In the present document, specified embodiments are described in the drawings and this detailed description, but this detailed description is not intended to limit the present disclosure to any specific embodiment. It shall be understood that embodiments of the present disclosure may be modified in a variety of different ways.

FIG. 1 is a block diagram illustrating an electronic device 101 in a network environment 100 according to certain embodiments.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly.

According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication.

According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)).

These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device 101 may communicate with a plurality of networks, e.g., first network 198 and second network 199. Although two networks are shown for illustrative purposes, it shall be understood that there may be more than two. The communication can be short-range wireless communication (such as Bluetooth, Wi-Fi, or NFC), or mobile communication such as 3G 4G or 5G Thus, in certain embodiments, the first network 198 can be a short range network while the second network 199 can be a mobile communication network. In order to communication with the first network 198 and the second network 199, the electronic device 101 may include a plurality of antennas.

As noted above, to facilitate communication on the plurality of networks, e.g., the first network 198 and the second network 199, the antenna module 197 may include a plurality of antennas. According to certain embodiments, the antennas have structure capable of improving EM isolation between antennas, decreasing EM coupling, and improving radiation efficiency.

Figure 2:
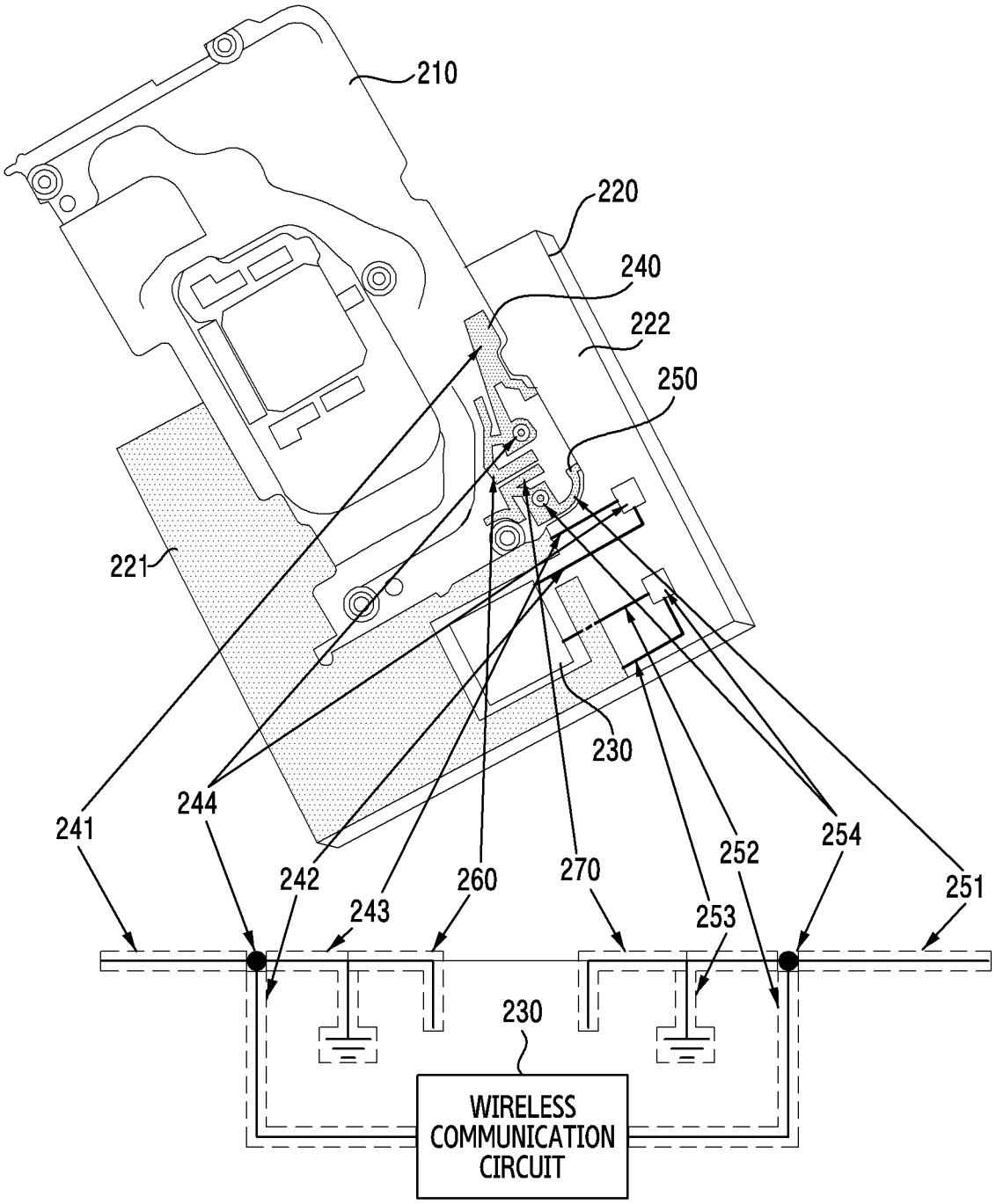
FIG. 2 is a diagram illustrating an antenna structure of an electronic device according to an embodiment of the present disclosure.

FIG. 2 is a diagram illustrating an antenna structure of an electronic device according to an embodiment of the present disclosure.

Referring to FIG. 2, the electronic device (e.g., the electronic device 101) of an embodiment of the present disclosure may include a housing 210, a printed circuit board 220, a wireless communication circuit 230, a first antenna 240, a second antenna 250, a first decoupling pattern 260, and a second decoupling pattern 270.

The first antenna 240 and the second antenna 250 use resonant decoupling using the first decoupling pattern 260, and a second decoupling pattern 270 to improve EM isolation between the first antenna 240 and the second antenna 250, decrease EM coupling, and improve radiation efficiency.

The housing 210 may include at least one component. The housing 210 may be formed of injection product and/or metal.

The printed circuit board 220 may be positioned within the housing 210, and include at least one electronic component (or element). For example, the printed circuit board 220 may mount the wireless communication circuit 230 thereon. The printed circuit board 220 may include a surface 221 that acts as the electrical ground and a fill-cut region 222.

The wireless communication circuit 230 may transmit or receive wireless signals using a first channel (a first wireless signal) through the first antenna 240 and/or transmit or receive wireless signals using a second channel (a second wireless signal) through the second antenna 250. For example, the wireless communication circuit 230 may support diversity transmissions and/or reception or multi input multi output (MIMO) transmission and/or reception for the first wireless signal and the second wireless signal having the same frequency band (e.g., a Wi-Fi band of 2.4 GHz to 2.5 GHz) through the first antenna 240 and the second antenna 250.

According to certain embodiments, the wireless communication circuit 230 may transmit and/or receive the first wireless signal (e.g., a Wi-Fi band signal of 2.4 GHz to 2.5 GHz) and the second wireless signal (e.g., an LTE B41 band signal of 2.5 GHz to 2.7 GHz) having an adjacent frequency band through the first antenna 240 and the second antenna 250, respectively. In the foregoing embodiment, the wireless communication circuit 230 may include a first communication module connected with the first antenna 240 and supporting a first communication protocol (e.g., Wi-Fi communication), and a second communication module connected with the second antenna 250 and supporting a second communication protocol (e.g., LTE communication) different from the first communication protocol.

The top portion of FIG. 2 illustrates that actual printed circuit board, while the bottom portion illustrates the equivalent circuit. The first antenna 240 and the second antenna 250 include decoupling patterns 260/270 connected to short-circuit patterns 243/253 grounding the antenna. The decoupling pattern 260 and 270 are spaced apart to realize a decoupling resonance frequency which allows resonance decoupling between the first antenna 240 and the second antenna 250.

Figure 3A:
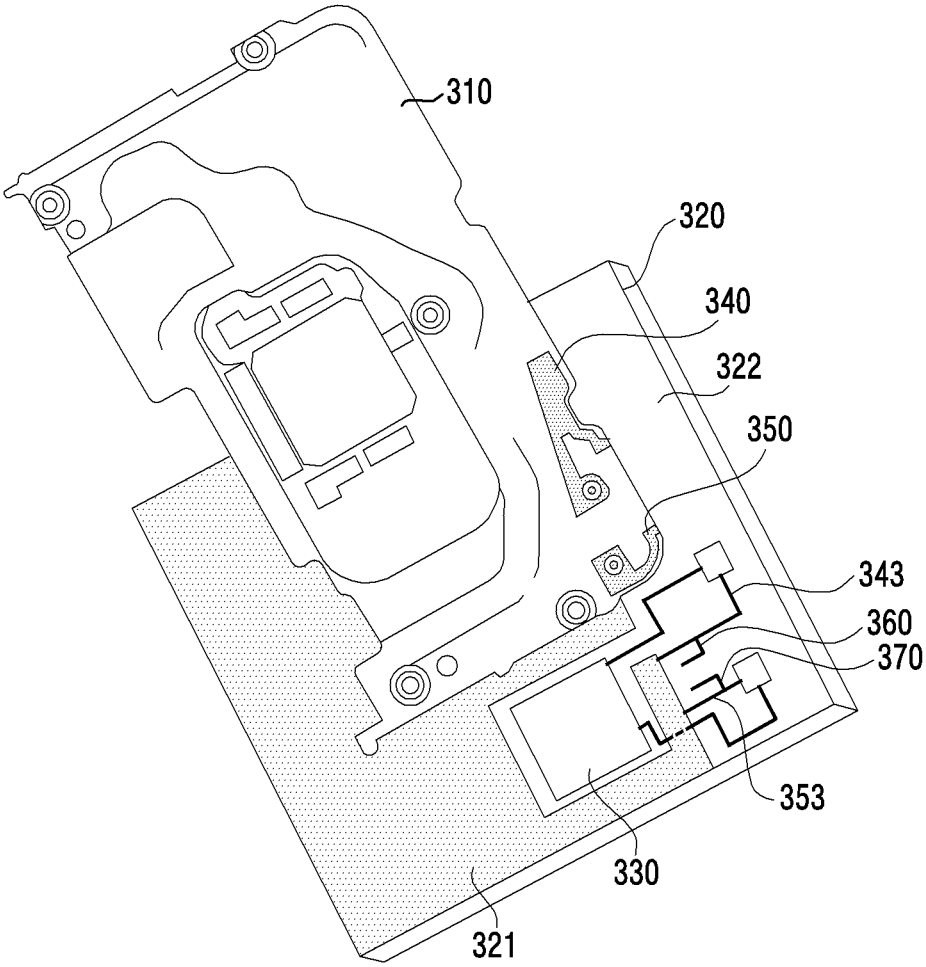
FIG. 3A is a diagram illustrating an antenna structure of an electronic device according to another embodiment of the present disclosure.

The short-circuit patterns 243/253 are connected to the other parts of the first antenna 240 and second antenna 250 via connection points 244/254. In certain embodiments, the decoupling patterns 260/270 can be disposed on the housing 210 (FIG. 2) while in other embodiments, the connection points 244/254 can be disposed on the printed circuit board (FIG. 3A).

The first antenna 240 may transmit or receive the first wireless signal. The first antenna 240 may include an inverted F-type antenna (IFA) or a planar inverted F-type antenna (PIFA). For example, the first antenna 240 may include a radiation pattern 241 (below, a first radiation pattern), a power feeding pattern 242 (below, a first power feeding pattern), and a short-circuit pattern 243 (below, a first short-circuit pattern).

The first short-circuit pattern 243 may be connected to ground 221 of the printed circuit board 220. The first power feeding pattern 242 may be connected with the wireless communication circuit 230, the first radiation pattern 241 and the first short-circuit pattern 243. The first power feeding pattern 242 may feed the first wireless signal to the first radiation pattern 241. The first radiation pattern 241 may radiate power (e.g., the first wireless signal) which is fed through the first power feeding pattern 242. The first radiation pattern 241 may have at least one resonance frequency. For example, the first radiation pattern 241 may have a resonance frequency corresponding to a frequency band for transmitting or receiving the first wireless signal.

Some constructions among the first radiation pattern 241, the first power feeding pattern 242, or the first short-circuit pattern 243 of the first antenna 240 may be positioned in the housing 210, and the remaining constructions thereof may be positioned in the printed circuit board 220. For example, the first radiation pattern 241 may be positioned in the housing 210, and the first power feeding pattern 242 and the first short-circuit pattern 243 may be positioned in the printed circuit board 220. A construction positioned in the housing 210 and a construction positioned in the printed circuit board 220 may be connected through a first contact 244 (below, a first contact structure). The first contact structure 244 may include a metal member (e.g., C-clip) (not shown) having elasticity, and a metal pad. However, an embodiment of the present disclosure is not limited to this, and the construction positioned in the housing 210 and the construction positioned in the printed circuit board 220 among the constructions of the first antenna 240 may be connected through known various structures.

The second antenna 250 may transmit or receive the second wireless signal. The second antenna 250 may include an IFA or a PIFA. For example, the second antenna 250 may include a radiation pattern 251 (below, a second radiation pattern), a power feeding pattern 252 (below, a second power feeding pattern), and a short-circuit pattern 253 (below, a second short-circuit pattern). Some constructions among the second radiation pattern 251, the second power feeding pattern 252, or the second short-circuit pattern 253 of the second antenna 250 may be positioned in the housing 210, and the remaining constructions may be positioned in the printed circuit board 220 and be connected by a second contact 254 (below, a second contact structure). Here, the second radiation pattern 251, the second power feeding pattern 252, the second short-circuit pattern 253 and the second contact structure 254 can be similar with the first radiation pattern 241, the first power feeding pattern 242, the first short-circuit pattern 243 and the first contact structure 244 in certain embodiments, and thus, a detailed description thereof is omitted.

Some (e.g., the radiation patterns 241 and 251) of the constructions of the first antenna 240 and the second antenna 250 may be formed by printing or depositing metal (e.g., copper or nickel) to one surface of the housing 210. For example, the first antenna 240 and the second antenna 250 may be laser direct structuring (LDS) antennas. Or, the first antenna 240 and the second antenna 250 may be formed by attaching a thin metal (e.g., copper) plate to the housing 210.

One side of the first decoupling pattern 260 may be connected with the first short-circuit pattern 243. One side of the second decoupling pattern 270 may be connected with the second short-circuit pattern 253, and be arranged within a specific distance from the first decoupling pattern 260.

The first decoupling pattern 260 and the second decoupling pattern 270 may be positioned in the housing 210. At least part of the first decoupling pattern 260 and at least part of the second decoupling pattern 270 may be arranged at a specified interval in parallel.

The first decoupling pattern 260 and the second decoupling pattern 270 may be decoupling resonant. By the decoupling resonance, interference (e.g., EM coupling, Rx desense, spurious, etc.) between the first antenna 240 and the second antenna 250 may be eliminated to decrease electromagnetic coupling and/or increase an electromagnetic isolation.

An interval between the first decoupling pattern 260 and the second decoupling pattern 270, and lengths (e.g., lengths of parallel portions) of the first decoupling pattern 260 and the second decoupling pattern 270 may be different according to a decoupling resonance frequency.

The first decoupling pattern 260 and the second decoupling pattern 270 may be formed by printing or depositing metal (e.g., copper or nickel) to one surface of the housing 210. Or, the first decoupling pattern 260 and the second decoupling pattern 270 may be formed by attaching a thin metal plate (e.g., copper) to the housing 210.

On the other hand, FIG. 2 illustrates that the other side of the first decoupling pattern 260 and the other side of the second decoupling pattern 270 are open (e.g., are not electrically connected with another construction) but, according to some embodiment, the other side of the first decoupling pattern 260 and the other side of the second decoupling pattern 270 may be connected with the ground 221.

According to some embodiment, the electronic device may further include a first tuning circuit (not shown) connected with the first decoupling pattern 260 and for adjusting a frequency of the decoupling resonance, and a second tuning circuit (not shown) connected with the second decoupling pattern 270 and for adjusting a frequency of the decoupling resonance. The first tuning circuit and the second tuning circuit may be positioned in the printed circuit board 220. The first tuning circuit and the second tuning circuit may include at least one of a resistor, an inductor or a capacitor.

FIG. 3A is a diagram illustrating an antenna structure of an electronic device according to another embodiment of the present disclosure.

In the embodiment of FIG. 3A, the decoupling patterns 360/370 are disposed on the printed circuit board 320.

Referring to FIG. 3A, the electronic device (e.g., the electronic device 101) of an embodiment of the present disclosure may include a housing 310, a printed circuit board 320, a wireless communication circuit 330, a first antenna 340, a second antenna 350, a first decoupling pattern 360, and a second decoupling pattern 370.

The housing 310, the printed circuit board 320, the wireless communication circuit 330, the first antenna 340, and the second antenna 350 of the electronic device are similar with the housing 210, the printed circuit board 220, the wireless communication circuit 230, the first antenna 240, and the second antenna 250 of FIG. 2 and thus, a detailed description thereof is omitted.

Unlike FIG. 2, the first decoupling pattern 360 and the second decoupling pattern 370 may be positioned in the printed circuit board 320. For example, one side of the first decoupling pattern 360 may be connected with a first short-circuit pattern 343 positioned in a fill-cut region 322, and one side of the second decoupling pattern 370 may be connected with a second short-circuit pattern 353. At least part of the first decoupling pattern 360 and at least part of the second decoupling pattern 370 may be arranged at a specific interval in parallel. By the at least part of the first decoupling pattern 360 and the at least part of the second decoupling pattern 370 arranged in parallel, a decoupling resonance may take place. By the decoupling resonance, electromagnetic coupling between the first antenna 340 and the second antenna 350 may be decreased, and an electromagnetic isolation may be increased.

According to certain embodiments, the other side of the first decoupling pattern 360 and the other side of the second decoupling pattern 370 may be connected with the ground 321.

Figure 3B:
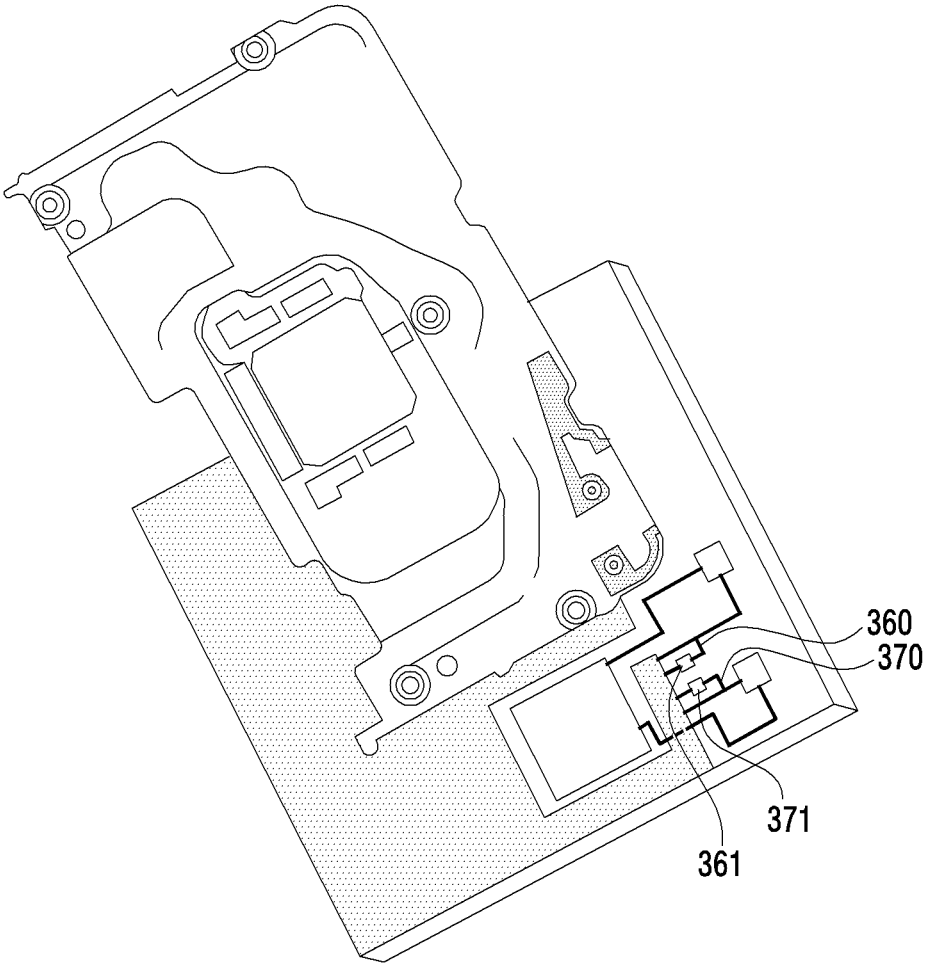
FIG. 3B is a diagram illustrating an antenna structure of an electronic device according to a further embodiment of the present disclosure.

FIG. 3B is a diagram illustrating an antenna structure of an electronic device according to a further embodiment of the present disclosure.

Referring to FIG. 3B, the electronic device (e.g., the electronic device 101) of an embodiment of the present disclosure is similar with the electronic device of FIG. 3A.

The electronic device may further include a first tuning circuit 361 connected with the first decoupling pattern 360 and for adjusting a frequency of the decoupling resonance, and a second tuning circuit 371 connected with the second decoupling pattern 370 and for adjusting a frequency of the decoupling resonance. In certain embodiments, the first tuning circuit 361 and the second tuning circuit 371 can be connected to ground.

The first tuning circuit 361 and the second tuning circuit 371 may include at least one of a resistor, an inductor or a capacitor.

Figure 4:
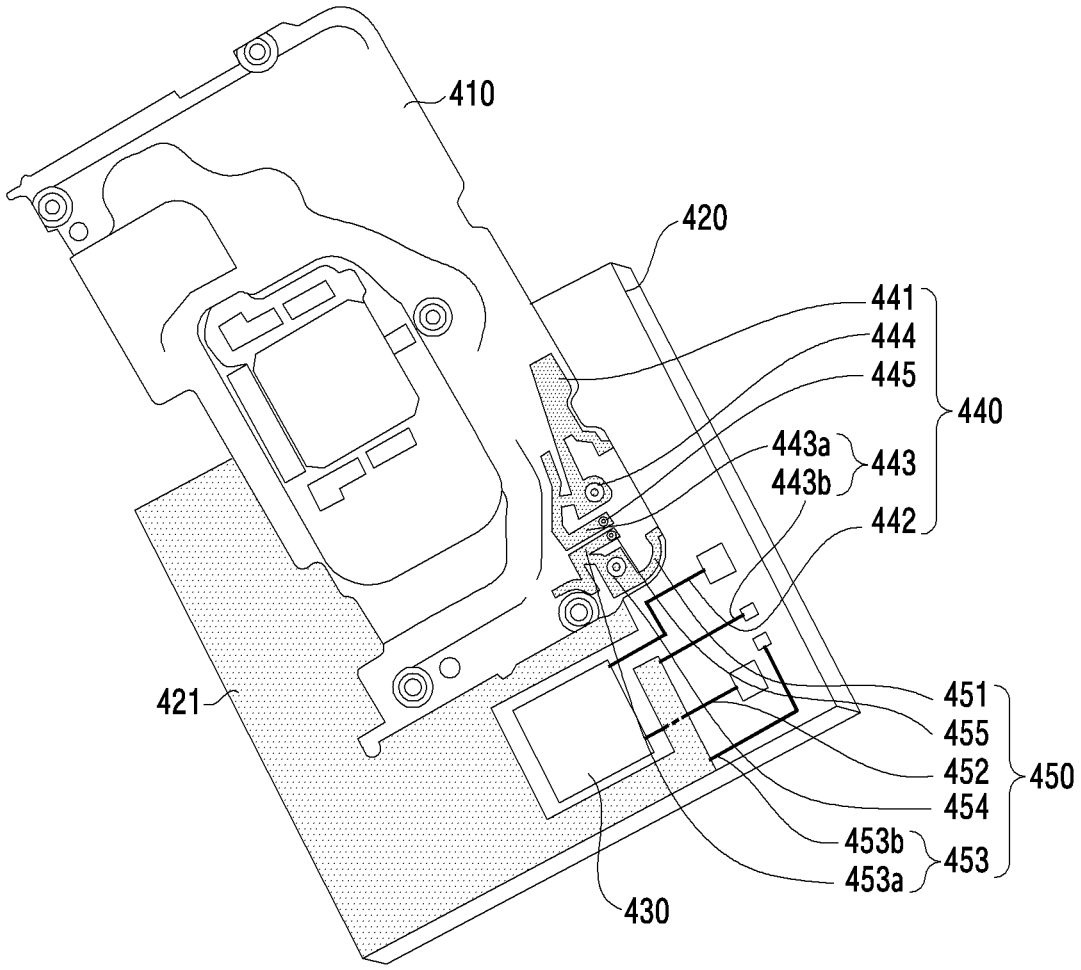
FIG. 4 is a diagram illustrating an antenna structure of an electronic device according to a yet another embodiment of the present disclosure.

FIG. 4 is a diagram illustrating an antenna structure of an electronic device according to a yet another embodiment of the present disclosure. In FIG. 4, the radiation patterns 441, 451, part 443*a*/453*a* of the short circuit patterns 443/453, and contacts 444, 445, 454, 455 are disposed on the housing 410, while the feeding patterns 442, 452 and another part 443*b*/453*b* of the short circuit patterns 443/453 are disposed on the printed circuit board 420.

Referring to FIG. 4, the electronic device (e.g., the electronic device 101) of an embodiment of the present disclosure may include a housing 410, a printed circuit board 420, a wireless communication circuit 430, a first antenna 440, and a second antenna 450.

The housing 410, the printed circuit board 420, and the wireless communication circuit 430 of FIG. 4 are similar with the housing 210, the printed circuit board 220, and the wireless communication circuit 230 of FIG. 2 and thus, a detailed description thereof is omitted.

The first antenna 440 and the second antenna 450 may transmit and/or receive a first wireless signal and a second wireless signal, respectively. The first antenna 440 and the second antenna 450 may include an IFA or a PIFA. The first antenna 440 may include a first radiation pattern 441, a first power feeding pattern 442, and a first short-circuit pattern 443. The second antenna 450 may include a second radiation pattern 451, a second power feeding pattern 452, and a second short-circuit pattern 453. Here, the first radiation pattern 441, the first power feeding pattern 442, the second radiation pattern 451, and the second power feeding pattern 452 are similar with the first radiation pattern 241, the first power feeding pattern 242, the second radiation pattern 251, and the second power feeding pattern 252 of FIG. 2 and thus, a detailed description thereof is omitted.

The first short-circuit pattern 443 and the second short-circuit pattern 453 may be each connected with the ground 421 of the printed circuit board 420. A part 443*a* of the first short-circuit pattern 443 positioned in the housing 410 and a part 453*a* of the second short-circuit pattern 453 positioned in the housing 410 may be arranged at a specific interval in parallel. By the patterns 443*a* and 453*a* arranged at the specific interval in parallel, a decoupling resonance may take place. By the decoupling resonance, interference between the first antenna 440 and the second antenna 450 may be prevented.

An interval between the part 443*a* of the first short-circuit pattern 443 and the part 453*a* of the second short-circuit pattern 453, and lengths of the part 443*a* of the first short-circuit pattern 443 and the part 453*a* of the second short-circuit pattern 453 may be different according to a decoupling resonance frequency.

The first power feeding pattern 442 may be connected with the first radiation pattern 441 through a first contact structure 444. The second power feeding pattern 452 may be connected with the second radiation pattern 451 through a second contact structure 454. The part 443*a* of the first short-circuit pattern 443 positioned in the housing 410 may be connected with the other part 443*b* of the first short-circuit pattern 443 positioned in the printed circuit board 420 through a third contact structure 445. The part 453*a* of the second short-circuit pattern 453 positioned in the housing 410 may be connected with the other part 453*b* of the second short-circuit pattern 453 positioned in the printed circuit board 420 through a fourth contact structure 455.

According to some embodiment, the electronic device may further include a first tuning circuit (not shown) connected with the first short-circuit pattern 443 and for adjusting a frequency of the decoupling resonance, and a second tuning circuit (not shown) connected with the second short-circuit pattern 453 and for adjusting a frequency of the decoupling resonance. The first tuning circuit and the second tuning circuit may be positioned in the printed circuit board 420. The first tuning circuit and the second tuning circuit may include at least one of a resistor, an inductor or a capacitor.

Figure 5A:
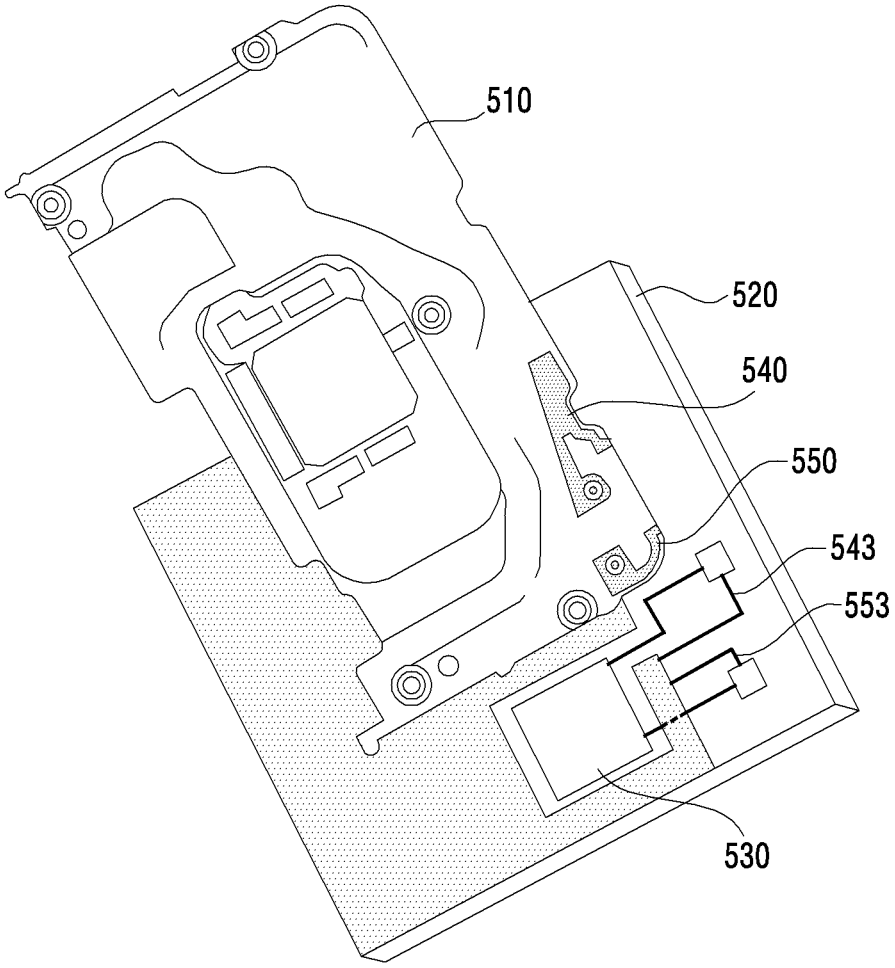
FIG. 5A is a diagram illustrating an antenna structure of an electronic device according to a still another embodiment of the present disclosure.

FIG. 5A is a diagram illustrating an antenna structure of an electronic device according to a still another embodiment of the present disclosure.

Referring to FIG. 5A, the electronic device (e.g., the electronic device 101) of an embodiment of the present disclosure may include a housing 510, a printed circuit board 520, a wireless communication circuit 530, a first antenna 540, and a second antenna 550.

The housing 510, the printed circuit board 520, and the wireless communication circuit 530 of the electronic device are similar with the housing 410, the printed circuit board 420, and the wireless communication circuit 430 of FIG. 4 and thus, a detailed description thereof is omitted.

Unlike FIG. 4, a first short-circuit pattern 543 and a second short-circuit pattern 553 may be positioned only in the printed circuit board 520. A part of the first short-circuit pattern 543 and a part of the second short-circuit pattern 553 may be arranged at a specific interval in parallel. By the part of the first short-circuit pattern 543 and the part of the second short-circuit pattern 553 arranged in parallel, a decoupling resonance may take place. By the decoupling resonance, electromagnetic coupling between the first antenna 540 and the second antenna 550 may be decreased, and an electromagnetic isolation may be increased.

Figure 5B:
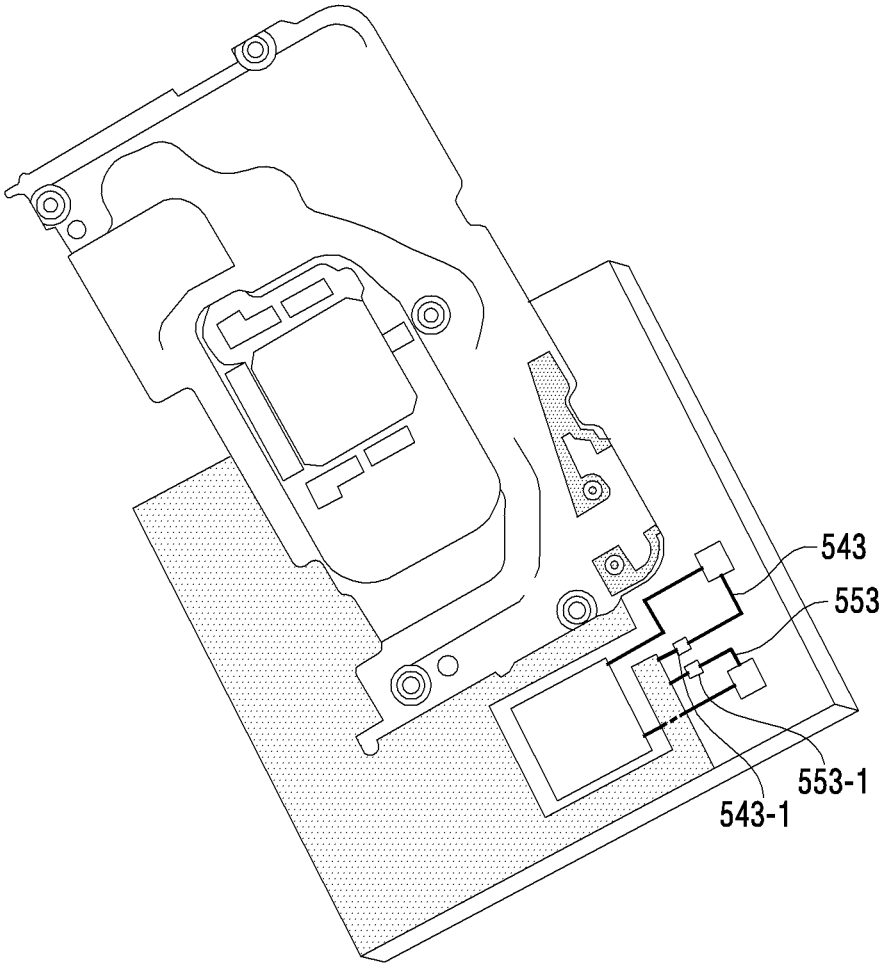
FIG. 5B is a diagram illustrating an antenna structure of an electronic device according to a still another embodiment of the present disclosure.

FIG. 5B is a diagram illustrating an antenna structure of an electronic device according to a still another embodiment of the present disclosure.

Referring to FIG. 5B, the electronic device (e.g., the electronic device 101) of a still another embodiment of the present disclosure is similar with the electronic device of FIG. 5A.

The electronic device may further include a first tuning circuit 543-1 connected with the first short-circuit pattern 543 and for adjusting a frequency of the decoupling resonance, and a second tuning circuit 553-1 connected with the second short-circuit pattern 553 and for adjusting a frequency of the decoupling resonance.

The first tuning circuit 543-1 and the second tuning circuit 553-1 may include at least one of a resistor, an inductor or a capacitor.

Figure 6:
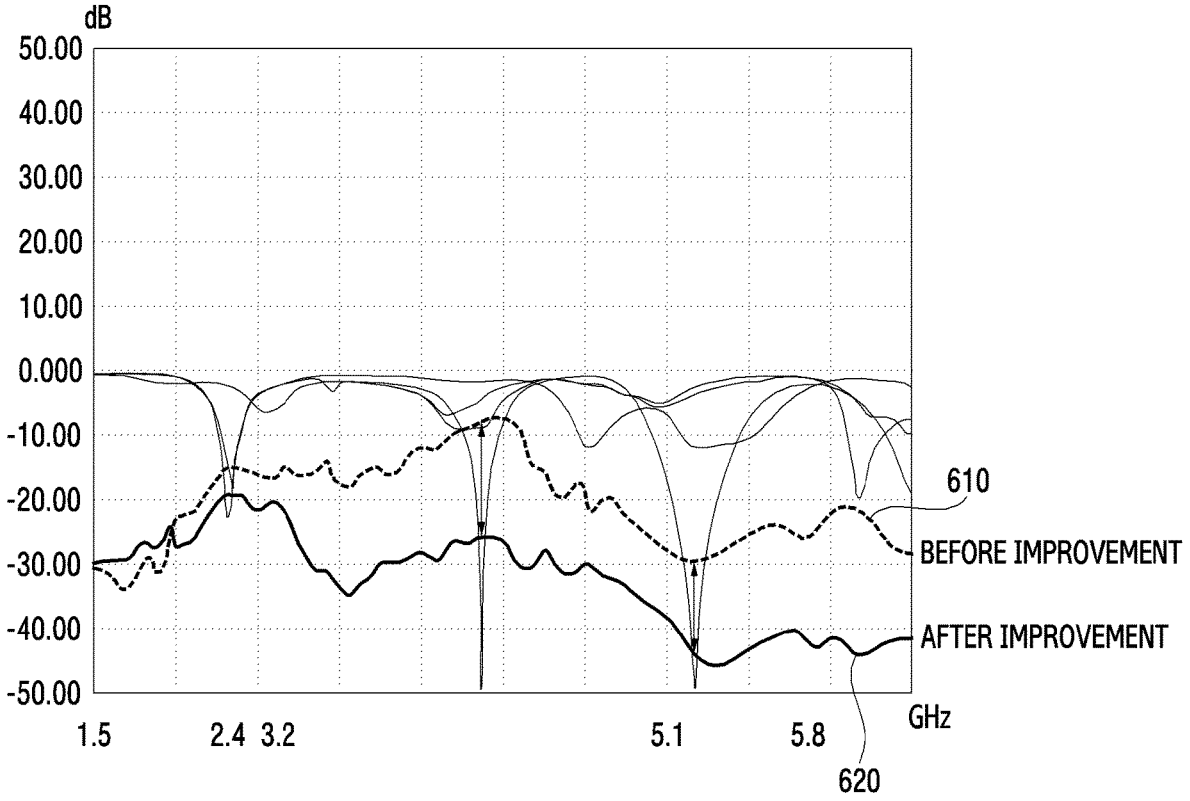
FIG. 6 is a graph illustrating a measurement result of the radiation performance of an antenna according to an embodiment of the present disclosure.

FIG. 6 is a graph illustrating a measurement result of the radiation performance of an antenna according to an embodiment of the present disclosure.

The graphs compare antenna performance. First graph 610 represents the S-parameter S12 between a first antenna and a second antenna without the short-circuit pattern and decoupling patterns. The second graph 620 represents the S-parameter S12 between a first antenna and a second antenna having a short-circuit pattern and decoupling patterns.

In a comparison of the first graph 610 and the second graph 620, it may be appreciated that S12 has been improved by about 5 dB over a range of frequencies between about 2.0 GHz-3.1 GHz, and by about 15 dB over a fairly broad range of frequencies exceeding 3.1 GHz. It may be appreciated that, by the decoupling resonance, an intensity in which a signal of the first antenna is induced to the second antenna is considerably decreased, and electromagnetic isolation is improved. This is because the first antenna and the second antenna are better electrically isolated by the decoupling resonance between constructions (e.g., the short-circuit patterns and/or the decoupling patterns) of the first antenna and the second antenna.

According to certain embodiments of the present disclosure, an electronic device (e.g., the electronic device (101)) may comprise: a housing (e.g., the housing (410), the housing (510)); a printed circuit board (e.g., the printed circuit board (420), the printed circuit board (520)) positioned within the housing, and comprising a ground; a wireless communication circuit (e.g., the wireless communication module (192), the wireless communication circuit (430), the wireless communication circuit(530)) mounted on the printed circuit board; a first antenna (e.g., the first antenna (440), the first antenna (540)) configured to transmit or receive a first wireless signal with the wireless communication circuit; and a second antenna (e.g., the second antenna (450), the second antenna (550)) configured to transmit or receive a second wireless signal with the wireless communication circuit, wherein the first antenna comprises a first short-circuit pattern (e.g., the first short-circuit pattern (443), the first short-circuit pattern (543)) connected to the ground, and the second antenna comprises a second short-circuit pattern (e.g., the second short-circuit pattern (453), the second short-circuit pattern (553)) connected to the ground, and at least part of the first short-circuit pattern and at least part of the second short-circuit pattern are adjacently arranged to be occurred a decoupling resonance.

According to certain embodiments, the at least part of the first short-circuit pattern and the at least part of the second short-circuit pattern may be positioned in the printed circuit board or the housing.

According to certain embodiments, the electronic device may further comprise: a first tuning circuit (e.g., the first tuning circuit (543-1)) connected with the first short-circuit pattern, and configured to adjust a decoupling resonance frequency; and a second tuning circuit (e.g., the second tuning circuit (553-1)) connected with the second short-circuit pattern, and configured to adjust the decoupling resonance frequency.

According to certain embodiments, the first antenna and the second antenna may comprise an inverted F-type antenna (IFA) or a planar inverted F-type antenna (PIFA).

According to certain embodiments, the first antenna may further comprise: a first power feeding pattern (e.g., the first power feeding pattern (442)) connected with the wireless communication circuit and the first short-circuit pattern; and a first radiation pattern (e.g., the first radiation pattern (441)) connected with the first short-circuit pattern and the first power feeding pattern and transmitting or receiving the first wireless signal. The second antenna may further comprise: a second power feeding pattern (e.g., the second power feeding pattern (452)) connected with the wireless communication circuit and the second short-circuit pattern; and a second radiation pattern (e.g., the second radiation pattern (451)) connected with the second short-circuit pattern and the second power feeding pattern and transmitting or receiving the second wireless signal.

According to certain embodiments, the first radiation pattern and the second radiation pattern may be positioned in the housing. The first power feeding pattern and the second power feeding pattern may be positioned on the printed circuit board. The electronic device may further comprise a first contact (e.g., the first contact structure (444)) connecting the first radiation pattern to the first power feeding pattern and a second contact (e.g., the second contact structure (454)) connecting the second radiation pattern to the second power feeding pattern.

According to certain embodiments, at least part of the first short-circuit pattern and at least part of the second short-circuit pattern may be disposed at a specified interval in parallel.

According to certain embodiments, the interval and lengths of the at least part of the first short-circuit pattern and the at least part of the second short-circuit pattern may be determined by a frequency of the decoupling resonance.

According to certain embodiments of the present disclosure, an electronic device (e.g., the electronic device (101)) may comprise: a housing (e.g., the housing (210), the housing (310)); a printed circuit board (e.g., the printed circuit board (220), the printed circuit board (320)) positioned within the housing, and comprising a ground; a wireless communication circuit (e.g., the wireless communication module (192), the wireless communication circuit (230), the wireless communication circuit (330)) mounted on the printed circuit board; a first antenna (e.g., the first antenna (240), the first antenna (340)) connected with the wireless communication circuit, and comprising a first short-circuit pattern (e.g., the first short-circuit pattern (243), the first short-circuit pattern (343)); a second antenna (e.g., the second antenna (250), the second antenna (350)) connected with the wireless communication circuit, and comprising a second short-circuit pattern (e.g., the second short-circuit pattern (253), the second short-circuit pattern (353)); a first decoupling pattern (e.g., the first decoupling pattern (260), the first decoupling pattern (360)) connected with the first short-circuit pattern; and a second decoupling pattern (e.g., the second decoupling pattern (270), the second decoupling pattern (370)) connected with the second short-circuit pattern, and disposed a specified distance from the first decoupling pattern, wherein at least part of the first decoupling pattern and at least part of the second decoupling pattern are adjacently arranged to be occurred a decoupling resonance.

According to certain embodiments, at least part of the first decoupling pattern and at least part of the second decoupling pattern may be positioned in the printed circuit board or the housing.

According to certain embodiments, the electronic device may further comprise: a first tuning circuit (e.g., the first tuning circuit (361)) connected with the first decoupling pattern, and configured to adjust a decoupling resonance frequency; and a second tuning circuit (e.g., the second tuning circuit (371)) connected with the second decoupling pattern, and configured to adjust the decoupling resonance frequency.

According to certain embodiments, the first decoupling pattern and the second decoupling pattern may be connected to the ground.

According to certain embodiments, the first antenna and the second antenna may comprise an inverted F-type antenna (IFA) or a planar inverted F-type antenna (PIFA).

According to certain embodiments, the first decoupling pattern and the second decoupling pattern may be arranged at a specified interval in parallel.

According to certain embodiments, the interval and lengths of the at least part of the first decoupling pattern and the at least part of the second decoupling pattern may be determined by a frequency of the decoupling resonance.

According to certain embodiments, of the present disclosure, an antenna apparatus may comprise: a housing; a first antenna positioned in one surface of the housing, and configured to transmit or receive a first wireless signal; a second antenna positioned in one surface of the housing, and configured to transmit or receive a second wireless signal; a first decoupling pattern connected with a first short-circuit pattern of the first antenna; and a second decoupling pattern connected with a second short-circuit pattern of the second antenna, and arranged within a specific distance from the first decoupling pattern, wherein at least part of the first decoupling pattern and at least part of the second decoupling pattern are adjacently arranged to be occurred a decoupling resonance.

According to certain embodiments, the first decoupling pattern and the second decoupling pattern may be disposed at a specified interval in parallel.

According to certain embodiments, the interval and lengths of the at least part of the first decoupling pattern and the at least part of the second decoupling pattern may be determined by a frequency of the decoupling resonance.

According to certain embodiments, the first decoupling pattern and the second decoupling pattern may be parts of the first short-circuit pattern and the second short-circuit pattern.

According to certain embodiments, the first antenna and the second antenna may comprise an inverted F-type antenna (IFA) or a planar inverted F-type antenna (PIFA).

The electronic device of certain embodiments of the present disclosure may improve an electromagnetic isolation between adjacent antennas, to increase a radiation efficiency of the antenna. Also, certain embodiments of the present disclosure may improve the degree of freedom in arranging a plurality of antennas in the electronic device.

The electronic device according to certain embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that certain embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

What is claimed is:

1. An electronic device comprising:

a housing;

a printed circuit board positioned within the housing, and comprising a ground;

a wireless communication circuit mounted on the printed circuit board;

a first antenna configured to transmit or receive a first wireless signal with the wireless communication circuit; and a second antenna transmit or receive a second wireless signal with the wireless communication circuit, wherein the first antenna comprises a first short-circuit pattern connected to the ground, and the second antenna comprises a second short-circuit pattern connected to the ground, wherein at least part of the first short-circuit pattern and at least part of the second short-circuit pattern are adjacently arranged to decouple using resonance decoupling, wherein the at least part of the first short-circuit pattern and the at least part of the second short-circuit pattern are disposed at a specified interval in parallel, and wherein the interval and lengths of the at least part of the first short-circuit pattern and the at least part of the second short-circuit pattern are determined based on a decoupling resonance frequency.

2. The electronic device of claim 1, wherein the at least part of the first short-circuit pattern and the at least part of the second short-circuit pattern are positioned in the printed circuit board or the housing.

3. The electronic device of claim 1, further comprising:

a first tuning circuit connected with the first short-circuit pattern, and configured to adjust the decoupling resonance frequency; and a second tuning circuit connected with the second short-circuit pattern, configured to adjust the decoupling resonance frequency.

4. The electronic device of claim 1, wherein the first antenna and the second antenna comprise an inverted F-type antenna (IFA) or a planar inverted F-type antenna (PIFA).

5. The electronic device of claim 1, wherein the first antenna further comprises:

a first power feeding pattern connected with the wireless communication circuit and the first short-circuit pattern; and a first radiation pattern connected with the first short-circuit pattern and the first power feeding pattern and transmitting or receiving the first wireless signal, and wherein the second antenna further comprises:

a second power feeding pattern connected with the wireless communication circuit and the second short-circuit pattern; and a second radiation pattern connected with the second short-circuit pattern and the second power feeding pattern and transmitting or receiving the second wireless signal.

6. The electronic device of claim 5, wherein the first radiation pattern and the second radiation pattern are positioned in the housing, and the first power feeding pattern and the second power feeding pattern are positioned on the printed circuit board, further comprising a first contact connecting the first radiation pattern to the first power feeding pattern and a second contact connecting the second radiation pattern to the second power feeding pattern.

7. An electronic device comprising:

a housing;

a printed circuit board positioned within the housing, and comprising a ground;

a wireless communication circuit mounted on the printed circuit board;

a first antenna connected with the wireless communication circuit, and comprising a first short-circuit pattern;

a second antenna connected with the wireless communication circuit, and comprising a second short-circuit pattern;

a first decoupling pattern connected with the first short-circuit pattern; and a second decoupling pattern connected with the second short-circuit pattern, and disposed a specified distance from the first decoupling pattern, wherein at least part of the first decoupling pattern and at least part of the second decoupling pattern are adjacently arranged to decouple using resonance decoupling, wherein the at least part of the first decoupling pattern and the at least part of the second decoupling pattern are disposed at a specified interval in parallel, and wherein the interval and lengths of the at least part of the first decoupling pattern and the at least part of the second decoupling pattern are determined based on a decoupling resonance frequency.

8. The electronic device of claim 7, wherein at least part of the first decoupling pattern and at least part of the second decoupling pattern are positioned in the printed circuit board or the housing.

9. The electronic device of claim 7, further comprising:

a first tuning circuit connected with the first decoupling pattern, configured to adjust the decoupling resonance frequency; and a second tuning circuit connected with the second decoupling pattern configured to adjust the decoupling resonance frequency.

10. The electronic device of claim 7, wherein the first decoupling pattern and the second decoupling pattern are connected to the ground.

11. The electronic device of claim 7, wherein the first antenna and the second antenna comprise an inverted F-type antenna (IFA) or a planar inverted F-type antenna (PIFA).

12. An antenna apparatus comprising:

a housing;

a first antenna positioned in one surface of the housing, and configured to transmit or receive a first wireless signal;

a second antenna positioned in one surface of the housing, and configured to transmit or receive a second wireless signal;

a first decoupling pattern connected with a first short-circuit pattern of the first antenna; and a second decoupling pattern connected with a second short-circuit pattern of the second antenna, and arranged within a specific distance from the first decoupling pattern, wherein at least part of the first decoupling pattern and at least part of the second decoupling pattern are adjacently arranged to decouple using resonance decoupling, wherein the at least part of the first decoupling pattern and the at least part of the second decoupling pattern are disposed at a specified interval in parallel, and wherein the interval and lengths of the at least part of the first decoupling pattern and the at least part of the second decoupling pattern are determined based on a decoupling resonance frequency.

13. The antenna apparatus of claim 12, wherein the first decoupling pattern and the second decoupling pattern are parts of the first short-circuit pattern and the second short-circuit pattern.

14. The antenna apparatus of claim 12, wherein the first antenna and the second antenna comprise an inverted F-type antenna (IFA) or a planar inverted F-type antenna (PIFA).

* * * * *